US005253586A

United States Patent [19]

Worsey

[11] Patent Number: 5,253,586

[45] Date of Patent: Oct. 19, 1993

[54] METHOD OF STEMMING A BLAST HOLE

[75] Inventor: Paul N. Worsey, Rolla, Mo.

[73] Assignee: The Curators of the University of Missouri, Columbia, Mo.

[21] Appl. No.: 961,487

[22] Filed: Oct. 15, 1992

[51] Int. Cl.[5] ..... F42B 3/00

[52] U.S. Cl. ..... 102/313; 102/333

[58] Field of Search ..... 102/312, 313, 333

[56] References Cited

U.S. PATENT DOCUMENTS

| | | | |
|---|---|---|---|
| 85,888 | 1/1869 | Ball | 102/333 |
| 155,731 | 10/1874 | Kalmbach | 102/30 |
| 1,131,876 | 10/1913 | Tietig | 102/30 |
| 1,841,874 | 1/1932 | Borchgrevink | 102/333 X |
| 2,300,813 | 11/1942 | Savage | 102/333 X |
| 2,403,386 | 7/1946 | Lubelsky et al. | 102/30 |
| 2,646,845 | 7/1953 | Schillinger | 102/333 X |
| 2,703,528 | 3/1955 | Lee et al. | 102/313 |
| 2,876,700 | 3/1959 | Householder | 102/333 |
| 2,995,087 | 8/1961 | Edney et al. | 102/30 |
| 3,075,463 | 1/1963 | Eilers et al. | 102/312 X |
| 3,151,556 | 10/1964 | Karpovich | 102/333 |
| 3,173,368 | 3/1965 | Griffith et al. | 102/333 |
| 3,264,992 | 8/1966 | Beck | 102/333 |
| 3,366,056 | 1/1968 | Thunell et al. | 102/333 |
| 3,608,491 | 9/1971 | Botes | 102/333 |
| 3,954,058 | 5/1976 | Sanders et al. | 102/30 |
| 4,449,754 | 5/1984 | Orlov et al. | 102/333 X |
| 4,470,352 | 9/1984 | Leperre | 102/333 |
| 4,572,075 | 2/1986 | Day et al. | 102/333 X |
| 4,669,540 | 6/1987 | Luoma et al. | 102/333 |
| 4,754,705 | 6/1988 | Worsey | 102/333 |
| 5,105,743 | 4/1992 | Tano et al. | 102/313 |

FOREIGN PATENT DOCUMENTS

| | | | |
|---|---|---|---|
| 1168059 | 12/1958 | France | 102/333 |

*Primary Examiner*—Peter A. Nelson

*Attorney, Agent, or Firm*—Senniger, Powers, Leavitt & Roedel

[57] ABSTRACT

A method of stemming a blast hole loaded with an explosive charge. The blast hole has side walls, an outwardly opening mouth and a central axis extending longitudinally of the blast hole. The method comprises inserting a conduit having a discharge end inwardly through the mouth of the blast hole and positioning the discharge end of the conduit within the blast hole generally adjacent the explosive charge. Particulate stemming material is forced under pressure through the conduit for exit from its discharge end into the blast hole toward the explosive charge thereby to pack stemming material in the blast hole adjacent the explosive charge. As stemming material is forced out the discharge end of the conduit, the discharge end of the conduit is moved generally axially outwardly relative to the blast hole toward the mouth of the blast hole to simultaneously fill and pack the blast hole with stemming material.

19 Claims, 3 Drawing Sheets

X
26
22
20
24
30
36
28
34
32

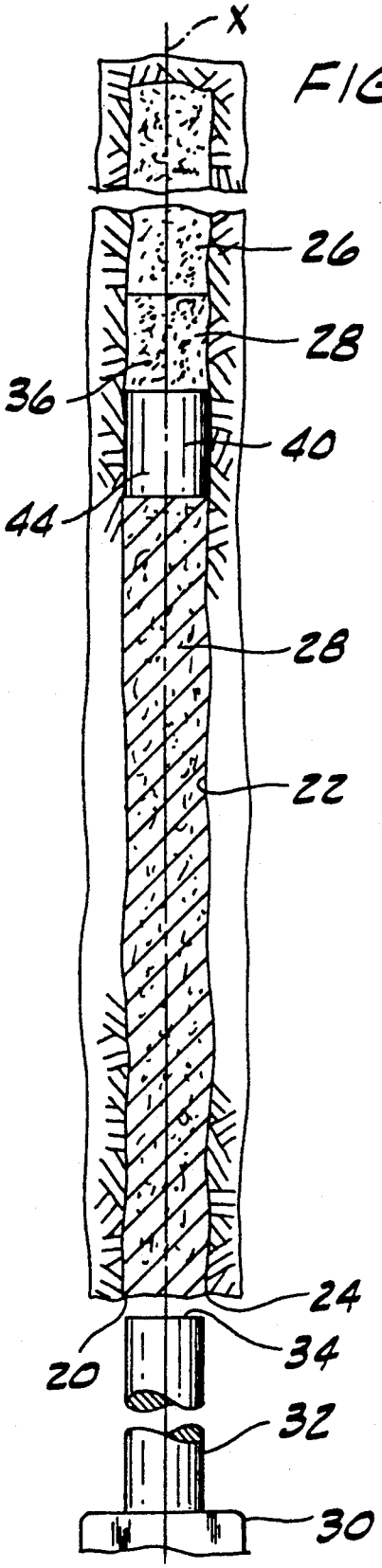
FIG. 9
FIG. 10
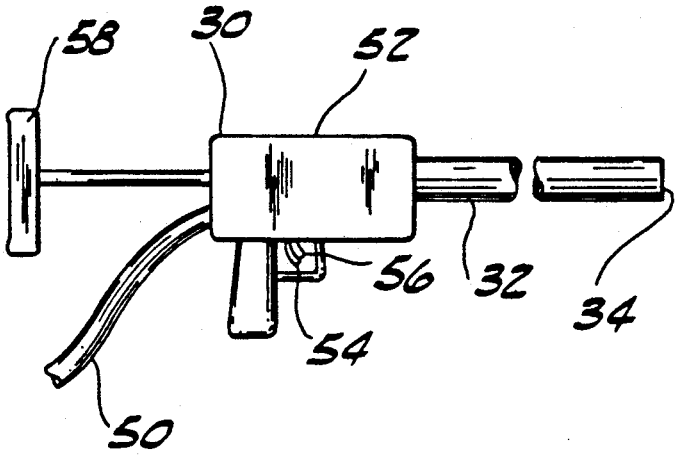

METHOD OF STEMMING A BLAST HOLE

BACKGROUND OF THE INVENTION

This invention relates to a method of stemming explosive loaded blast holes.

Blasting is used in construction and mining to fragment solid rock so that it can be removed. A number of blast holes are drilled and filled with explosive charges which are detonated to produce shock waves that rupture the surrounding rock. There are a number of parameters that govern the effectiveness of a blast, including geologic structure, the size and spacing of the blast holes, the burden (distance to the free face of the rock surrounding the blast hole), the type, amount, and placement of explosive, the sequence of detonation, and the stemming technique used.

Stemming is the plugging of the blast hole to prevent the escape of blast gasses. This is important because the blast gasses perform the primary work of the blast. If the blast gasses escape, the effectiveness of the blast is diminished, wasting explosive and requiring additional blasting which entails additional risk and increased drilling, labor, and material costs.

An upwardly opening blast hole is typically stemmed with a free-flowing (loose) particulate stemming material, which is poured into the blast hole and then tamped (compacted). Stemming a downwardly opening or horizontal blast hole with free-flowing particulate stemming material, however, is difficult because the stemming material cannot be poured into the hole. Also, the stemming material would gravitate from a downwardly opening blast hole. A downwardly opening or horizontal blast hole may be stemmed with cartridge-type stemming material. However, this procedure is relatively time consuming and expensive. Because of the difficulties associated with stemming downwardly opening or horizontal blast holes, such holes are often not stemmed at all. Thus, the effectiveness of the blast is substantially reduced.

SUMMARY OF THE INVENTION

Among the objects of the present invention may be noted the provision of an improved method for stemming a blast hole; the provision of such a method for quickly stemming horizontal and downwardly opening blast holes; the provision of such a method which utilizes free-flowing particulate stemming material; the provision of such a method which is simple and easy to employ; and the provision of such a method which permits the use of a blasting plug (such as the plug described in U.S. Pat. No. 4,754,705) in the stemming process.

The method of this invention is for stemming a blast hole loaded with an explosive charge. The blast hole has side walls, an outwardly opening mouth and a central axis extending longitudinally of the blast hole. The method comprises inserting a conduit having a discharge end inwardly through the mouth of the blast hole and positioning the discharge end of the conduit within the blast hole generally adjacent the explosive charge. Particulate stemming material is forced under pressure through the conduit for exit from its discharge end into the blast hole in a generally axially inward direction toward the explosive charge thereby to pack stemming material in the blast hole adjacent the explosive charge. As stemming material is forced out the discharge end of the conduit, the discharge end of the conduit is moved generally axially outwardly relative to the blast hole toward the mouth of the blast hole to simultaneously fill and pack the blast hole with stemming material.

These and other advantages and features of the present invention will be in part apparent and in part pointed out hereinafter.

BRIEF DESCRIPTION OF THE DRAWINGS

FIG. 9 is a side elevational view of the blast hole of FIG. 8 showing the blast hole filled with stemming material and the conduit removed from the blast hole; and FIG. 10 is a side elevational view of the gun used for stemming the blast hole.

Corresponding reference characters indicate corresponding parts throughout the several views of the drawings.

DETAILED DESCRIPTION OF THE PREFERRED EMBODIMENTS

Figures 1, 2, 3, 4:
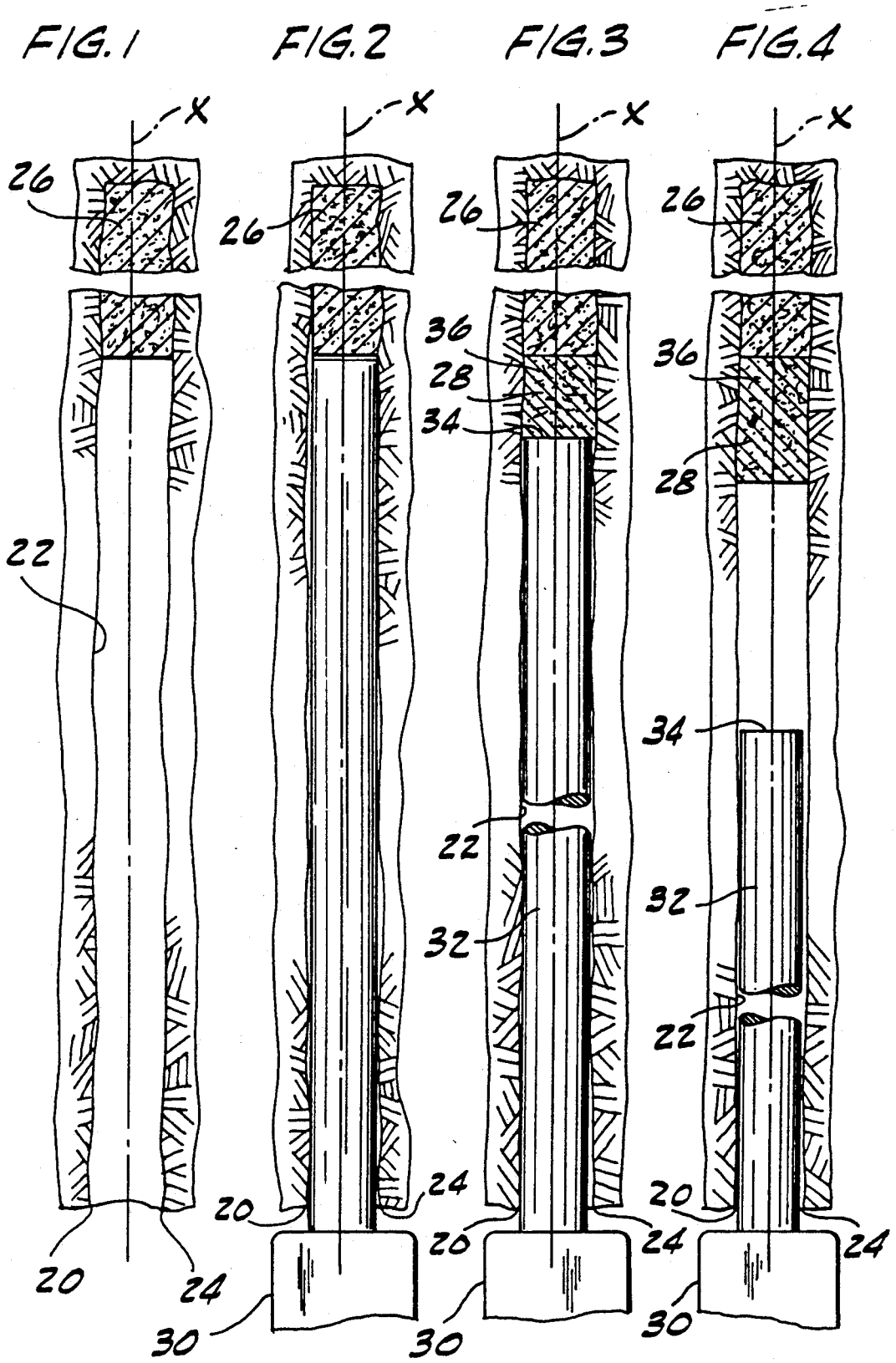
FIG. 1 is a side elevational view of a blast hole loaded with an explosive charge.
FIG. 2 is a side elevational view of the blast hole of FIG. 1 showing a conduit inserted in the hole for delivering stemming material to the blast hole.
FIG. 3 is a side elevational view of the blast hole of FIG. 2 showing particulate stemming material being discharged from the discharge end of the conduit and forming a slug of stemming material.
FIG. 4 is a side elevational view of the blast hole of FIG. 3 showing the slug completely formed and the conduit being removed from the blast hole.

A method of stemming a blast hole 20 according to the principles of this invention is shown in FIGS. 1–9. The blast hole 20 has side walls 22, an outwardly (downwardly) opening mouth 24 and a central axis X extending longitudinally of the blast hole 20. An explosive charge 26, such as ammonium nitrate fuel oil (ANFO) or any other suitable blasting agent, is within the blast hole 20, typically generally adjacent its inner (upper) end. In addition, various detonators (not shown) may be provided as necessary. Although the blast hole 20 is shown as being a vertical, downwardly opening hole, it is to be understood that the method of this invention is equally suitable for stemming inclined blast holes drilled up at an angle, horizontal blast holes, and vertical and inclined blast holes having upwardly opening mouths.

Particulate stemming material 28 is forced into the blast hole 20 by a device 30 which may be referred to as a "gun." The stemming material 28 may be sand, clay granules, or any other suitable particulate material. The gun 30 comprises a conduit 32 (barrel) having a discharge end 34 (muzzle). As discussed in greater detail below, the gun 30 is adapted for pressurized delivery of particulate stemming material through the conduit 32 for exit from its discharge end 34.

As shown in FIG. 2, the conduit 32 is inserted upwardly through the mouth 24 of the blast hole 20 to a position wherein the discharge end 34 of the conduit 32 is generally adjacent the explosive charge 26. Preferably, the diameter of the conduit is slightly smaller than the diameter of the blast hole and the length of the conduit is at least equal to the distance from the mouth 24 of the blast hole 20 to the explosive charge 26. With the conduit 32 in the aforementioned position, the gun 30 is discharged to force the stemming material 28 under pressure (e.g., approximately 50 psi) through the conduit 32 and out its discharge end 34 to pack a metered amount of stemming material in the blast hole 20 adjacent the explosive charge 26 thereby to form a slug 36 of packed stemming material adjacent the explosive charge 26 (see FIG. 4). The stemming material 28 is packed sufficiently tight by the injection pressure of the gun that the particles of the stemming material 28 engage one another and the side walls 22 of the blast hole 20 to form a substantially unitary mass which resists gravitating downwardly relative to the blast hole 20. Preferably, the axial length of the slug 36 is approximately equal to 1.5–2.0 blast hole diameters.

Figure 5:
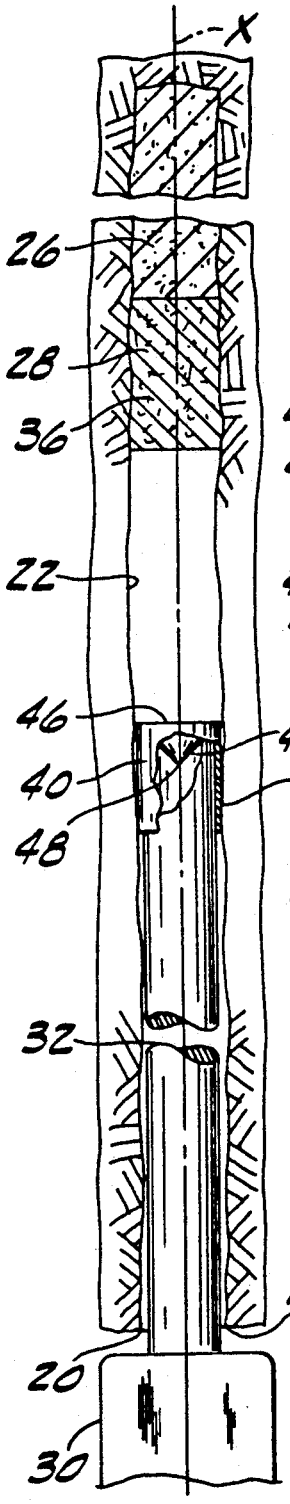
FIG. 5 is a side elevational view of the blast hole of FIG. 4 showing the conduit being reinserted into the blast hole with a blast plug attached to the discharge end of the conduit.
Figure 6:
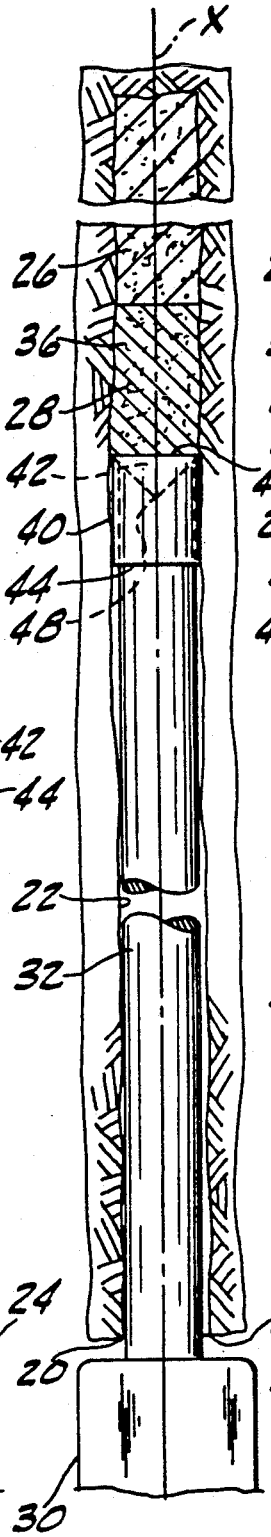
FIG. 6 is a side elevational view of the blast hole of FIG. 5 showing the blast plug positioned against the slug.
Figure 7:
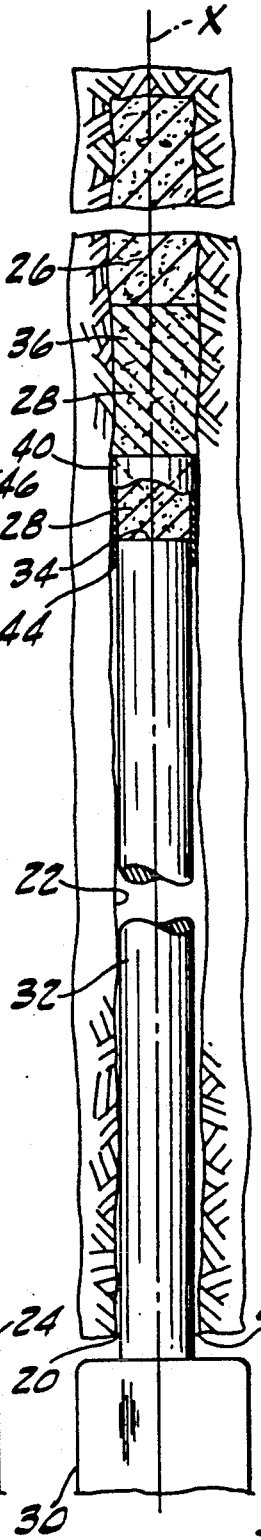
FIG. 7 is a side elevational view of the blast hole of FIG. 6 showing stemming material being discharged from the conduit to detach the blast plug from the conduit.
Figure 8:
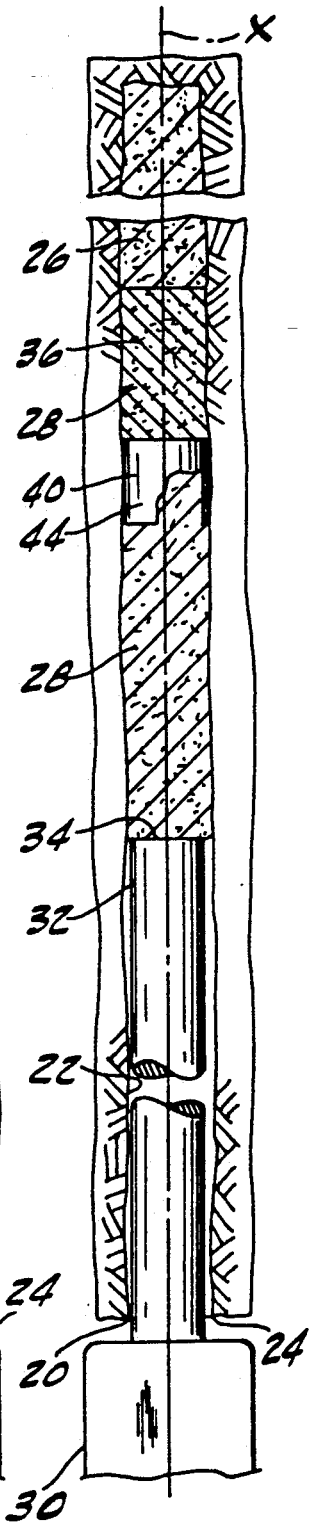
FIG. 8 is a side elevational view of the blast hole of FIG. 7 showing the discharge end of the conduit being moved toward the mouth of the blast hole and the blast hole being filled with stemming material.

Referring to FIG. 5, the conduit 32 is then removed from the blast hole 20 and a blast plug 40 is attached to the discharge end 34 of the conduit 32. The plug 40 comprises a generally cone-shaped wedge member 42 and a tubular sleeve 44. The wedge member 42 tapers from a relatively wide base 46 to a relatively narrow end 48. The sleeve 44 extends generally axially with respect to the wedge member 42 from adjacent the base 46 of the wedge member 42 toward the narrow end 48 of the wedge member 42. The blast plug 40 is described in greater detail in my U.S. Pat. application Ser. No. 07/961,130 incorporated herein by reference) filed Oct. 14, 1992. A different type Plug, such as described in U.S. Pat. No. 4,754,705, may alternatively be employed. The sleeve 44 is dimensioned for a close friction fit over the discharge end 34 of the conduit 32. The conduit 32 may also be provided with a clip (not shown) for releasably holding the plug 40 in place on the conduit 32. The discharge end 34 of the conduit 32 with the blast plug 40 thereon is inserted (see FIG. 5) through the mouth 24 of the blast hole 20 and the plug 40 is positioned within the blast hole 20 (see FIG. 6) axially outwardly of the slug 36 with the base 46 of the wedge member 42 pushed against the slug 36 to eliminate any major air void between the plug 40 and slug 36. The narrow end 48 of the wedge member 42 faces outwardly toward the mouth 24 of the blast hole 20. Stemming material 28 is then forced under pressure through the discharge end 34 of the conduit 32 axially inwardly (upwardly in FIG. 7) toward the slug 36 and against the blast plug 40 to detach the blast plug 40 from the conduit 32 and to pack stemming material against the plug 40 to retain it against the slug 36. As stemming material is forced out the discharge end 34 of the conduit 32, the discharge end 34 is moved axially outwardly (downwardly in FIG. 8) with respect to the blast hole 20 toward the mouth of the blast hole 20 to fill and pack the blast hole 20 with stemming material 28. As with the slug 36, the stemming material 28 below the plug 40 is packed sufficiently tight by the injection pressure of the gun that the particles of the stemming material 28 engage one another and the side walls 22 of the blast hole to resist gravitating downward relative to the blast hole 20.

The conduit 32 is preferably formed of a material, such as a polymeric resin embedded with carbon, which is sufficiently dielectric to prevent sparking of the conduit 32 during insertion into the blast hole 20, and sufficiently conductive to prevent build up of static charge as stemming material is forced through the conduit 32.

As depicted in FIG. 10, the gun 30 further includes a supply hose 50, a flow controller 52 (shown schematically) and first and second triggers 54 and 56. Air is blown through particulate stemming material in a hopper (not shown) to fluidize the stemming material. The hopper may be of a type similar to the pressurized hopper used on the charging vehicle (Model No. 2-1300 ANFO) sold by Getman Corp. of Bangor, Mich. The fluidized stemming material is transported under pneumatic pressure from the hopper through the supply hose 50 to the controller 52 and through the conduit 32. The particulate stemming material is preferably sufficiently fine so that it can be adequately fluidized to be moved through the supply hose 50 and conduit 32. The controller 52 controls the operation of a valve (not shown) located either in the gun 30 adjacent the conduit 32 or adjacent the hopper. Preferably, the valve is similar to the valve used in the aforementioned Getman hopper. When the first trigger 54 is pulled, the controller 52 opens the valve. The controller 52 maintains the valve open only for a predetermined duration to allow a metered amount of fluidized stemming material to be forced through the conduit 32. This metered amount preferably corresponds to an amount sufficient to form the slug 36. The amount of stemming material forced through the conduit upon pulling the first trigger 54 may be adjusted by varying the duration the valve is open or by varying the rate at which stemming material is forced through the conduit 32. Alternatively, the controller 52 may include a flow meter (not shown) which meters the amount of stemming material forced through the conduit 32, the controller 52 being operable to close the valve after a predetermined amount of stemming material passes therethrough. When the second trigger 56 is pulled, the controller 52 opens the valve to allow a stream of fluidized stemming material to flow through the conduit 32. The valve remains open until the second trigger 56 is released. The gun 30 further includes a stock 58 to help a user brace the gun 30 to prevent recoil of the conduit 32 from the hole 20 by the force of stemming material discharged from the conduit 32.

Typically, the blast hole 20 has a two inch diameter, is twelve feet deep, and all but two feet of the blast hole 20 is filled with the explosive charge 26. In operation, the conduit 32 is inserted into the blast hole 20. The first trigger 54 is pulled and a metered amount of the fluidized stemming material is forced under pressure into the blast hole 20 adjacent the explosive charge 26 to form the slug 36. The conduit 32 is then removed and the blast plug 40 releasably attached to its discharge end 34. The conduit 32 with the blast plug 40 thereon is then inserted up through the mouth of the blast hole 20 to a position in which the blast plug 40 is adjacent the slug 36, at which time the second trigger 56 is pulled to cause a stream of fluidized stemming material to be forced through the conduit 32 and out its discharge end 34. As the stemming material exits the conduit 32, it pushes against the blast plug 40 to detach it from the conduit 32. While continuing to pull the second trigger 56, the discharge end 34 of the conduit 32 is moved axially outwardly relative to the blast hole 20 to fill and pack the hole 20 with stemming material 28. When the hole is filled, the second trigger 56 is released and the valve is closed to stop the flow of fluidized stemming material.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A method of stemming a blast hole loaded with an explosive charge, said blast hole having side walls, an outwardly opening mouth and a central axis extending longitudinally of the blast hole, the method comprising the steps of:

inserting a blast plug through the mouth of the blast hole and positioning the blast plug axially outwardly of the explosive charge;

inserting a conduit having a discharge end inwardly through the mouth of the blast hole and positioning the discharge end of the conduit within the blast hole axially outwardly of the explosive charge;

forcing particulate stemming material under pressure through the conduit for exit from its discharge end into the blast hole in a generally axially inward direction to retain the plug within the blast hole; and as stemming material is being forced out of the discharge end of the conduit, moving the discharge end of the conduit generally axially outwardly relative to the blast hole toward the mouth of the blast hole to simultaneously fill and pack the blast hole with stemming material.

2. A method as set forth in claim 1 wherein said stemming material is forced into the blast hole under pneumatic pressure.

3. A method as set forth in claim 2 wherein the mouth of said blast hole opens downwardly, said stemming material being packed sufficiently tight that the particles of said stemming material engage one another and the side walls of the blast hole to resist gravitation of the stemming material outwardly relatively to the blast hole.

4. A method of stemming a blast hole loaded with an explosive charge, said blast hole having side walls, an outwardly opening mouth and a central axis extending longitudinally of the blast hole, the method comprising the steps of:

inserting a conduit having a discharge end inwardly through the mouth of the blast hole and positioning the discharge end of the conduit within the blast hole generally adjacent the explosive charge;

forcing particulate stemming material through said conduit to form a slug of packed stemming material in the blast hole axially outwardly of said explosive charge;

removing the conduit from the blast hole;

releasably attaching a blast plug to the discharge end of the conduit;

inserting the discharge end of the conduit with the blast plug thereon into the blast hole;

detaching the blast plug from the conduit;

forcing particulate stemming material through the discharge end of the conduit into the blast hole in a generally axially inward direction to retain the plug adjacent said slug of stemming material; and as stemming material is being forced out the discharge end of the conduit, moving the discharge end of the conduit generally axially outwardly relative to the blast hole toward the mouth of the blast hole to simultaneously fill and pack the blast hole with stemming material.

5. A method as set forth in claim 4 wherein the exit of stemming material from the discharge end of the conduit detaches the blast plug from the conduit.

6. A method as set forth in claim 5 wherein said plug comprises a wedge member tapering from a relatively wide base to a relatively narrow end, said method further comprising positioning the wedge member in the blast hole with its base facing inwardly toward the explosive charge and with its narrow end facing outwardly toward the mouth of the blast hole.

7. A method of stemming a blast hole loaded with an explosive charge, said blast hole having side walls, an outwardly opening mouth and a central axis extending longitudinally of the blast hole, the method comprising the steps of:

releasably attaching a blast plug to a discharge end of a conduit, said conduit being adapted for pressurized delivery of particulate stemming material through the conduit for exit from its discharge end;

inserting the discharge end of the conduit with the blast plug thereon through the mouth of the blast hole and positioning the blast plug within the blast hole axially outwardly of the explosive charge;

detaching the blast plug from the conduit;

forcing particulate stemming material under pressure through the discharge end of the conduit axially inwardly toward the explosive charge and against the blast plug to pack stemming material in the blast hole adjacent the blast plug; and as stemming material is forced out the discharge end of the conduit, moving the discharge end of the conduit axially outwardly with respect to the blast hole toward the mouth of the blast hole to fill and pack the blast hole with stemming material.

8. A method as set forth in claim 7 wherein forcing particulate stemming material under pressure through the discharge end of the conduit detaches the blast plug from the conduit.

9. A method as set forth in claim 7 wherein the mouth of said blast hole opens downwardly, said stemming material being packed sufficiently tight that the particles of said stemming material engage one another and the side walls of the blast hole to resist gravitation of the stemming material axially outwardly relative to the blast hole.

10. A method as set forth in claim 7 wherein said blast plug comprises a wedge member tapering from a relatively wide base to a relatively narrow end, said method further comprising positioning the wedge member in the blast hole with its base facing inwardly toward the explosive charge and with its narrow end facing outwardly toward the mouth of the blast hole.

11. A method as set forth in claim 10 wherein said wedge member is generally cone-shaped.

12. A method as set forth in claim 7 further comprising the initial step of placing a slug of stemming material in the blast hole axially outwardly of and adjacent the explosive charge.

13. A method as set forth in claim 12 wherein said slug comprises a metered amount of particulate stemming material.

14. A method as set forth in claim 13 wherein the step of placing the slug in the blast hole comprises:

inserting the discharge end of the conduit inwardly through the mouth of the blast hole and positioning the discharge end within the blast hole adjacent the explosive charge;

forcing a metered amount of particulate stemming material under pressure through the discharge end of the conduit axially inwardly into the blast hole toward the explosive charge to pack the stemming material in the blast hole adjacent the explosive charge.

15. A method as set forth in claim 12 wherein the step of inserting the blast plug further comprises positioning the blast plug adjacent the slug.

16. A method of stemming a blast hole loaded with an explosive charge, said blast hole having side walls, an outwardly opening mouth and a central axis extending longitudinally of the blast hole, the method comprising the steps of:

inserting a blast plug through the mouth of the blast hole;

inserting a conduit having a discharge end inwardly through the mouth of the blast hole;

manipulating the blast plug by means of the conduit to position the blast plug axially outwardly of the explosive charge;

forcing particulate stemming material under pressure through the discharge end of the conduit axially inwardly toward the explosive charge and against the blast plug to pack stemming material in the blast hole adjacent the blast plug; and as stemming material is forced out the discharge end of the conduit, moving the discharge end of the conduit axially outwardly with respect to the blast hole toward the mouth of the blast hole to fill and pack the blast hole with stemming material.

17. A method as set forth in claim 16 further comprising the initial step of placing a slug of stemming material in the blast hole axially outwardly of and adjacent the explosive charge.

18. A method as set forth in claim 17 wherein said slug comprises a metered amount of particulate stemming material.

19. A method as set forth in claim 18 wherein the step of placing the slug in the blast hole comprises:

inserting the discharge end of the conduit inwardly through the mouth of the blast hole and positioning the discharge end within the blast hole adjacent the explosive charge;

forcing a metered amount of particulate stemming material under pressure through the discharge end of the conduit axially inwardly into the blast hole toward the explosive charge to pack the stemming material in the blast hole adjacent the explosive charge.

* * * * *